US009989072B2

(12) United States Patent
Chang et al.

(10) Patent No.: US 9,989,072 B2
(45) Date of Patent: Jun. 5, 2018

(54) FAN

(71) Applicant: Delta Electronics, Inc., Taoyuan County (TW)

(72) Inventors: Shun-Chen Chang, Taoyuan County (TW); Bo-Chun Chen, Taoyuan County (TW); Shih-Han Huang, Taoyuan County (TW); Chao-Yu Chen, Taoyuan County (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 548 days.

(21) Appl. No.: 14/019,238

(22) Filed: Sep. 5, 2013

(65) Prior Publication Data

US 2014/0356149 A1 Dec. 4, 2014

(30) Foreign Application Priority Data

May 30, 2013 (CN) ..... 2013 1 0209111

(51) Int. Cl.

| | |
|---|---|
| ***F04D 29/66*** | (2006.01) |
| ***F04D 25/06*** | (2006.01) |
| ***F04D 29/32*** | (2006.01) |
| ***F04D 29/38*** | (2006.01) |
| ***F04D 29/54*** | (2006.01) |

(52) U.S. Cl.

CPC ..... *F04D 29/666* (2013.01); *F04D 25/0613* (2013.01); *F04D 29/325* (2013.01); *F04D 29/384* (2013.01); *F04D 29/542* (2013.01); *F04D 29/663* (2013.01)

(58) Field of Classification Search

CPC .... F04D 29/666; F04D 29/663; F04D 29/384; F04D 29/325; F04D 29/542; F04D 25/0613

See application file for complete search history.

(56) References Cited

U.S. PATENT DOCUMENTS

2006/0002103 A1* 1/2006 Lu ..... F04D 29/545 362/96
2008/0253897 A1* 10/2008 Yamamoto ..... F04D 29/384 416/223 R
2009/0246017 A1* 10/2009 Lee ..... F04D 25/0613 415/220

* cited by examiner

*Primary Examiner* — Woody Lee, Jr.
*Assistant Examiner* — Maxime Adjagbe
(74) *Attorney, Agent, or Firm* — Kirton McConkie; Evan R. Witt

(57) ABSTRACT

A fan includes an impeller and a frame. The frame is used for accommodating the impeller. The frame includes a plurality of static blade groups. Each of the static blade groups has a plurality of static blades. Moreover, at least one first static blade of a first static blade group and at least one first static blade of a second static blade group are symmetric with respect to a central axis of the frame.

20 Claims, 11 Drawing Sheets

FAN

FIELD OF THE INVENTION

The present invention relates to a fan, and more particularly to a fan capable of reducing noise effectively.

BACKGROUND OF THE INVENTION

With increasing development of science and technology, the performance of electronic devices is largely enhanced. Consequently, heat-dissipating devices or heat-dissipating systems become essential instruments for the electronic devices. During operation of an electronic device, the heat is generated by the electronic components of the electronic device. If the heat fails to be effectively dissipated away, the elevated operating temperature may result in damage, short circuit or deteriorated performance of the electronic device. For effectively removing the heat, it is important to install a high-performance heat-dissipating device within or beside the electronic device to exhaust the heat to the surroundings. Moreover, it is an important requirement to make efforts in increasing the efficiency of the heat-dissipating device.

A fan is one of the most popular heat-dissipating devices. Generally, the fan comprises a frame, static blades, a hub, and dynamic blades. The static blades are connected with the frame. The dynamic blades are connected with the hub. In addition, a motor (not shown) is installed within the hub. As the fan is driven to rotate by the motor, the dynamic blades arranged around the hub are synchronously rotated to produce airflow to dissipate heat.

For increasing the efficiency of the fan, the number of the static blades is usually in the range between 7 and 17. If the fan contains seven dynamic blades, the frequency of the noise generated by the fan is the multiple of 49~119 Hz. For example, if the rotating speed of the fan is 2,500 rpm, the frequency of the noise generated by the fan is about 2,000~5,000 Hz. As known, the hearing sensitivity of the human is dependent on the frequency of the sound. Generally, the frequency of the sound in the range between 2,500 Hz and 3,000 Hz is more sensitive to the human ears. Moreover, the sound in the low frequency range is less sensitive to the human ears. In other words, for maintaining or increasing the air pressure, the reduction of the noise is an important factor for selecting the fan.

SUMMARY OF THE INVENTION

The present invention provides a fan for reducing noise and effectively dissipating the heat away from an electronic device without deteriorating the original properties of the fan and solving the noise problems encountered by the prior arts.

In accordance with an aspect of the present invention, the fan includes an impeller and a frame. The frame is used for accommodating the impeller. The frame includes a plurality of static blade groups. Each of the static blade groups has a plurality of static blades. Moreover, at least one first static blade of a first static blade group and at least one first static blade of a second static blade group are symmetric with respect to a central axis of the frame.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
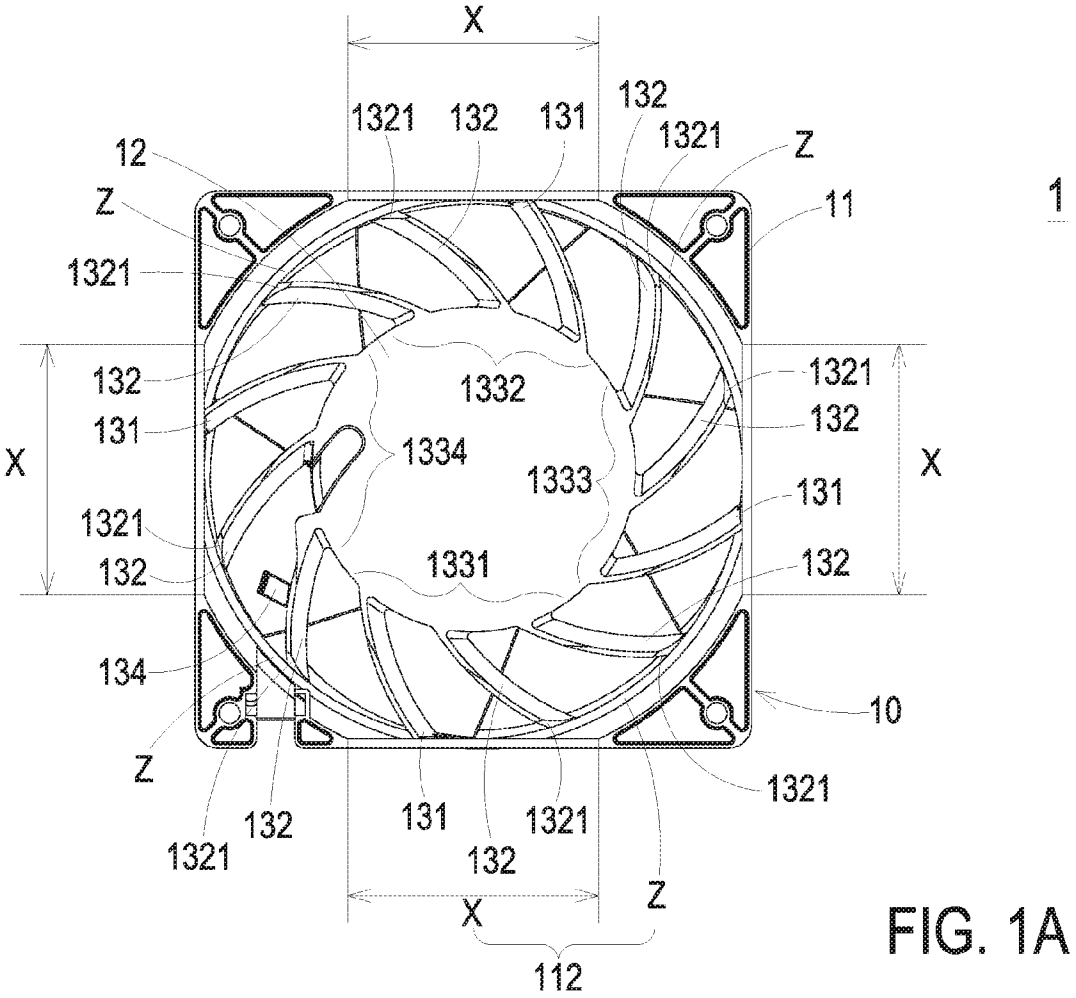
FIG. 1A is a front view of a fan according to a first embodiment of the present invention.
Figure 1B:
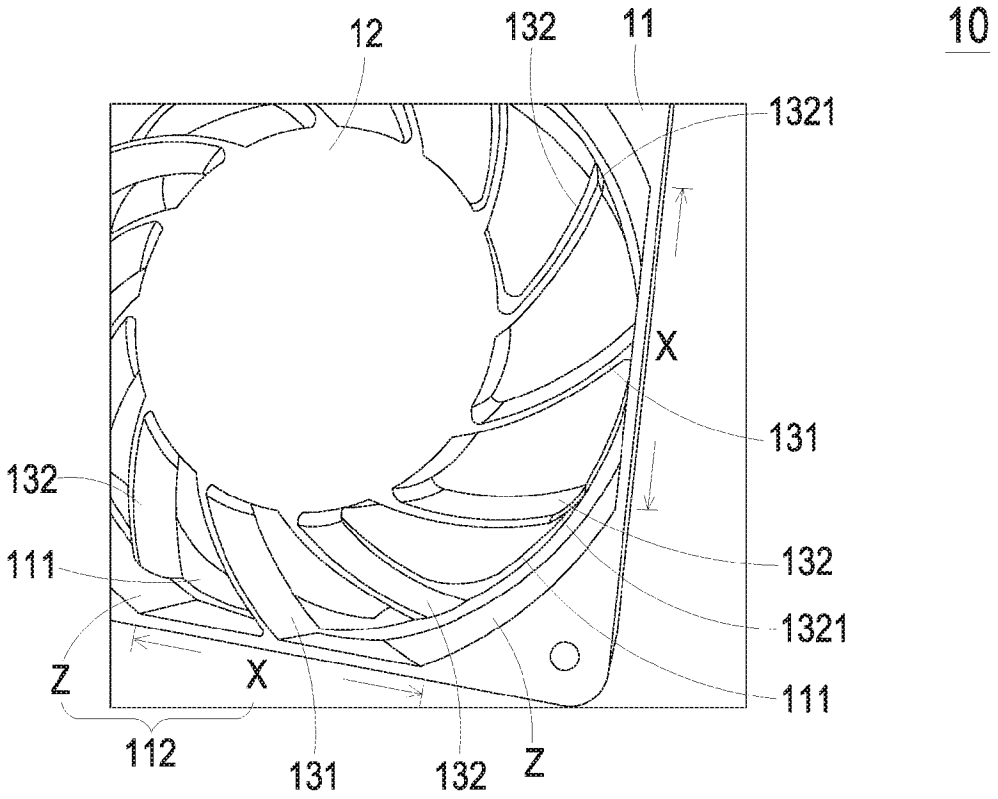
FIG. 1B is a perspective view of a portion of a frame of the fan shown in FIG. 1A.
Figure 1C:
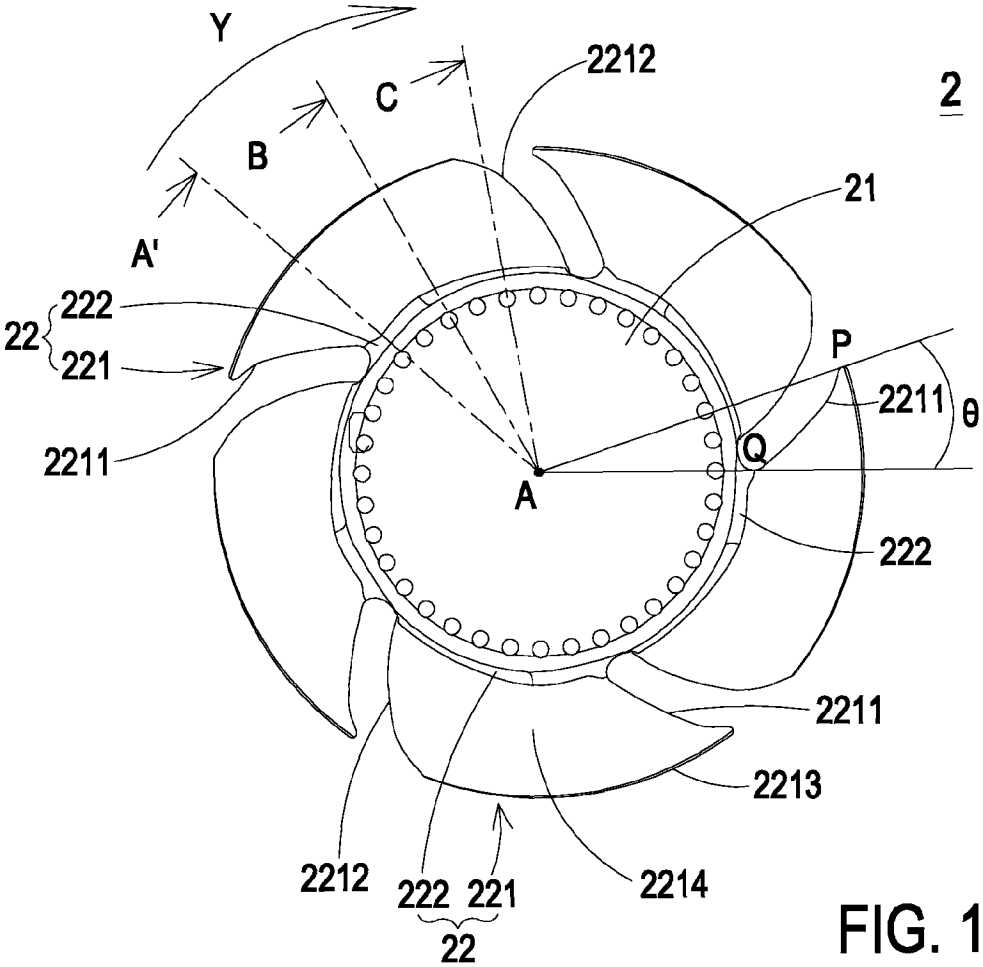
FIG. 1C is a front view illustrating an impeller of the fan shown in FIG. 1A.
Figure 1D:
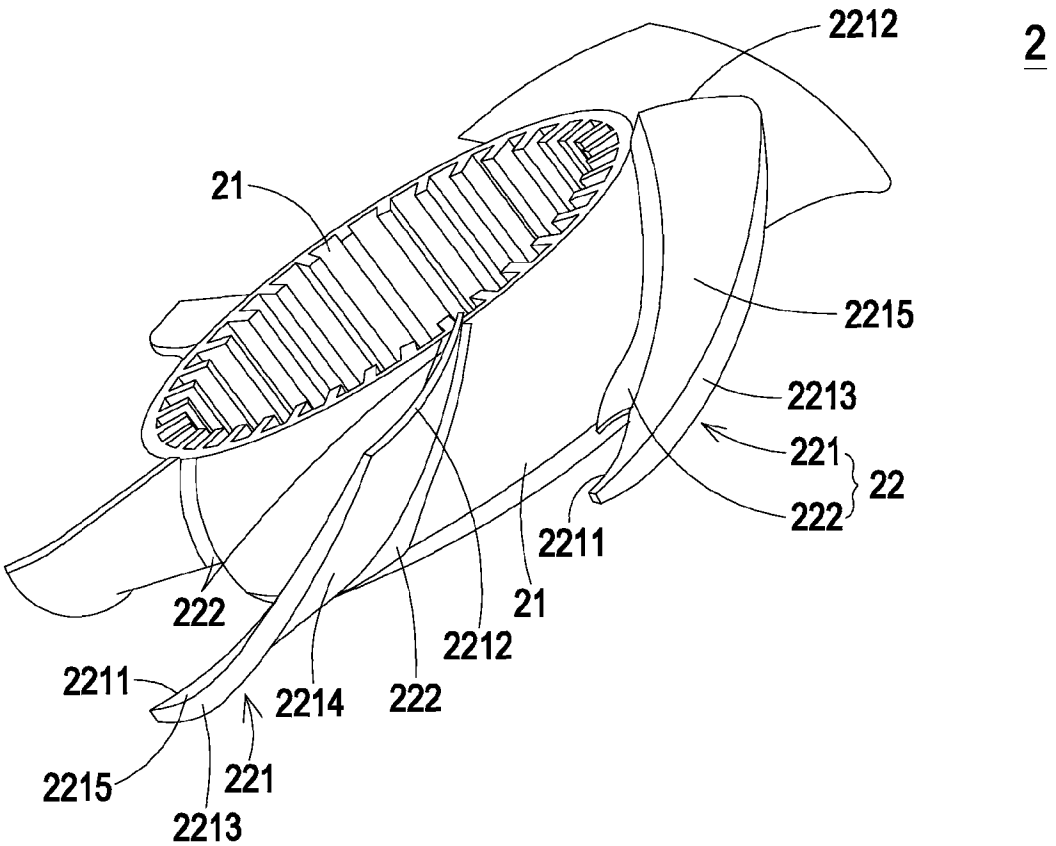
FIG. 1D is a perspective view of the impeller of the fan shown in FIG. 1A.
Figure 1G:
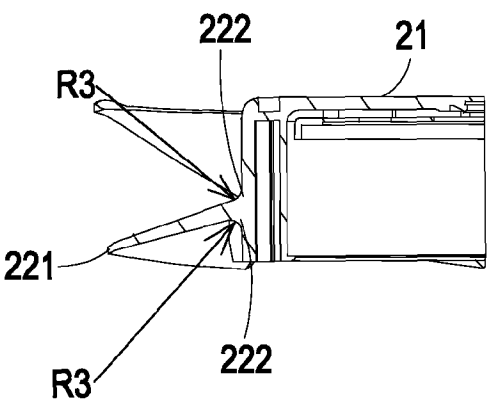
FIG. 1G is a cross-sectional view of the impeller of FIG. 1C along the line C-A.
Figure 1F:
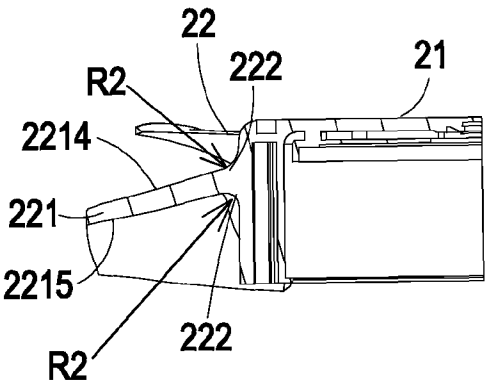
FIG. 1F is a cross-sectional view of the impeller of FIG. 1C along the line B-A.
Figure 1E:
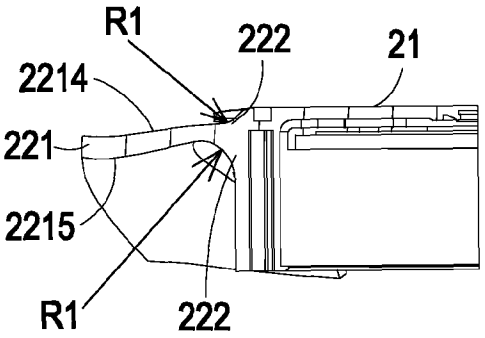
FIG. 1E is a cross-sectional view of the impeller of FIG. 1C along the line A'-A.

The present invention provides a fan. Hereinafter, a fan according to a first embodiment of the present invention will be illustrated with reference to FIGS. 1A~1G. FIG. 1A is a front view of a fan according to a first embodiment of the present invention. FIG. 1B is a perspective view of a portion of a frame of the fan shown in FIG. 1A. FIG. 1C is a front view illustrating an impeller of the fan shown in FIG. 1A. FIG. 1D is a perspective view of the impeller of the fan shown in FIG. 1A. FIGS. 1E~1G are cross-sectional views of the impeller of the fan of FIG. 1C along different viewpoints. In this embodiment, the fan 1 is an axial-flow fan. The fan 1 comprises a frame 10, an impeller 2, and a motor (not shown). The impeller 2 and the motor are accommodated within the frame 10. The motor is used for driving rotation of the impeller 2. The fan 1 of this embodiment can be applied to a power supply, a server, a communication apparatus, a vehicular electronic system, a computer system or any other electronic system.

The frame 10 of the fan 1 comprises a frame body 11, a base 12, a plurality of static blade groups, and a wire-managing groove 134. In this embodiment, the frame body 11 is a square frame body. Alternatively, in some other embodiments, the frame body 11 is a circular frame body. The frame body 11 comprises an axial part 111 and an externally-expanded part 112 as shown in FIG. 1B. An airflow channel is defined by the axial part 111. The axial part 111 is connected with the externally-expanded part 112. An outlet of the fan 1 is defined by the externally-expanded part 112. Moreover, the inner wall of the externally-expanded part 112 comprises a plurality of flat regions X and an outwardly angled region Z positioned between each pair of adjacent flat regions X. The flat regions X can be located at corresponding lateral sides of the frame body 11.

Moreover, each of the static blade groups comprises a plurality of static blades. In this embodiment, the frame 10 comprises four static blade groups 1331, 1332, 1333 and 1334. Each static blade group has the same number of static blades. For example, each of the static blade groups 1331, 1332, 1333 and 1334 comprises one first static blade 131 and two second static blades 132. The first static blade 131 is aligned with a corresponding flat region X, and thus the first static blade 131 extends between the base 12 and the corresponding flat region X. One end of the first static blade 131 is connected with the base 12. The other end of the first static blade 131 is partially connected with the axial part 111 and partially connected with the flat region X of the externally-expanded part 112. As used herein, the expression "the other end of the first static blade 131 is partially connected with the axial part 111 and partially connected with the flat region X of the externally-expanded part 112" means that a part of the other end of the first static blade 131 is connected with the axial part 111 and the rest of the other end of the first static blade 131 is connected with the flat region X of the externally-expanded part 112 completely, so that the other end of the first static blade 131 is completely connected with and not spaced from the frame body 11. Moreover, two second static blades 132 are arranged between every two adjacent first static blades 131. Each second static blade 132 extends between the base 12 and the outwardly angled region Z that is adjacent to the corresponding flat region X. One end of the second static blade 132 is connected with the base 12. The other end of the second static blade 132 is partially connected with the axial part 111. Since the second end of the second static blade 132 is not connected with the outwardly angled region Z of the externally-expanded part 112, the second static blade 132 has a suspension segment 1321 with respect to the externally-expanded part 112 as shown in FIG. 1B.

As known, since the static blade groups of the frame of the conventional fan are asymmetric, asymmetric flow fields are generated at the outlet of the fan. Under this circumstance, the conventional fan will result in serious vortex. In accordance with the present invention, the first static blades of two corresponding static blade groups are symmetric with respect to a central axis of the frame 10. In this embodiment, the first static blades 131 of the two corresponding static blade groups 1331 and 1332 are symmetric with respect to the central axis of the frame 10, and the first static blades 131 of the two corresponding static blade groups 1333 and 1334 are symmetric with respect to the central axis of the frame 10. Consequently, the outlet formed by the externally-expanded part 112 is divided into four identical flow fields, which are arranged around each other. Different flow fields will not be interfered with each other. Thus, the airflow at the outlet of the fan can be uniformly diffused and the possibility of causing vortex will be minimized. In other words, the heat of the electronic system can be uniformly dissipated away by the fan.

Figure 2:
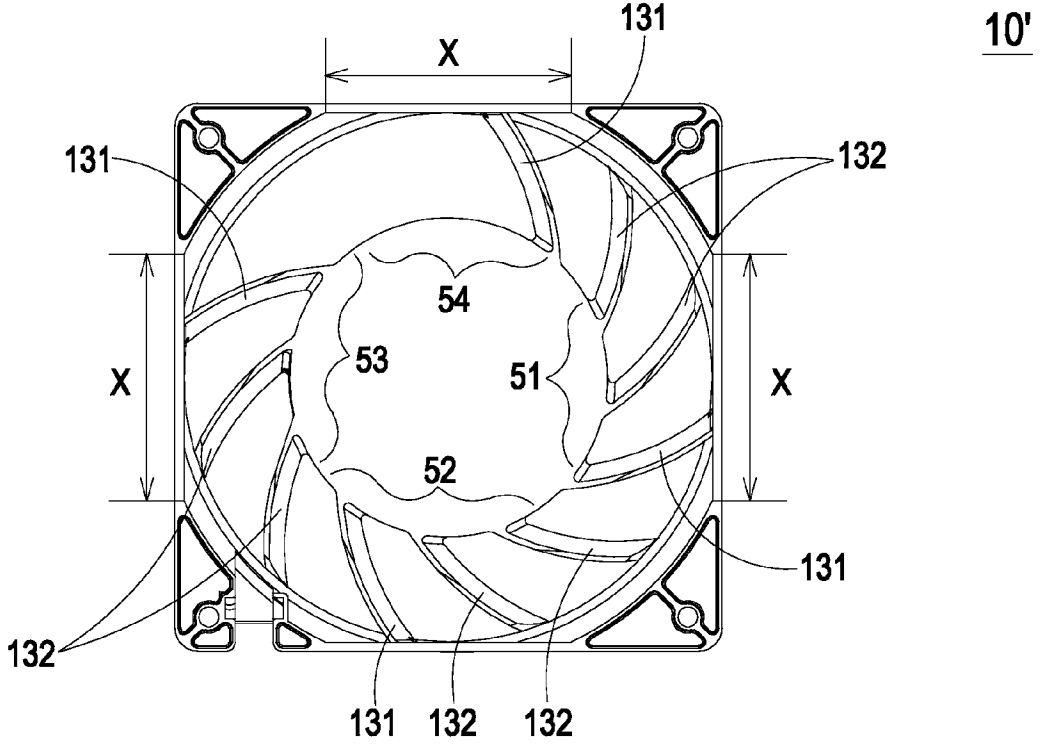
FIG. 2 is a front view of a frame of a fan according to a second embodiment of the present invention.

In the above embodiment, each static blade group has the same number of static blades. Alternatively, in another embodiment, different static blade groups can have different numbers of static blades. FIG. 2 is a front view of a frame of a fan according to a second embodiment of the present invention. The frame 10' comprises four static blade groups 51, 52, 53 and 54. The static blade group 51 comprises three static blades, including one first static blade 131 and two second static blades 132. The static blade group 52 comprises three static blades, including one first static blade 131 and two second static blades 132, wherein the first static blade 131 is located beside one of the two second static blades 132. The static blade group 53 comprises three static blades, including one first static blade 131 and two second static blades 132, wherein the first static blade 131 is located beside one of the two second static blades 132. In this embodiment, the first static blades 131 of the two corresponding static blade groups 51 and 53 are symmetric with respect to a central axis of the frame 10'. The static blade group 54 only comprises one first static blade 131. The first static blades 131 of the two corresponding static blade groups 52 and 54 are symmetric with respect to the central axis of the frame 10'. Consequently, the frequency of the noise generated by the dynamic blades will not be too centralized.

Please refer to FIGS. 1C and 1D again. The impeller 2 comprises a hub 21 and a plurality of dynamic blades 22. A motor (not shown) is disposed within the hub 21 for driving the impeller 2 to rotate. The dynamic blades 22 are arranged around the hub 21, and connected with the hub 21. As the impeller 2 is driven to rotate by the motor, the dynamic blades 22 are synchronously rotated to produce the airflow.

Each dynamic blade 22 comprises a blade body 221 and a connecting part 222. The blade body 221 comprises a front edge 2211, a rear edge 2212, and a wing tip 2213. The extending direction of the front edge 2211 and the rear edge 2212 is the same as the rotating direction of the impeller 2. The wing tip 2213 is opposed to the connecting part 222. Moreover, the wing tip 2213 is connected with the front edge 2211 and the rear edge 2212. The wing tip 2213 is twisted and extended along the rotating direction of the dynamic blade 22. Consequently, each dynamic blade 22 has a leading edge angle θ. The leading edge angle θ is defined between a farthest end point P of the front edge 2211 away from the center of the hub 21 and an end point Q at the junction between a root part of the front edge 2211 and the hub 21. That is, the leading edge angle θ is defined between a first line passing through a center A of the hub 21 and a farthest end point P of the front edge 2211 and a second line passing through the center A of the hub 21 and an end point Q at the junction between a root part of the front edge 2211 and the hub 21. In this embodiment, the leading edge angle θ is in the range between 15 degrees and 50 degrees, but is not limited thereto.

Due to the leading edge angle of each dynamic blade 22, the noise can be effectively reduced. Moreover, since there is no obvious vortex in the flow field generated by the dynamic blade 22, the fan can maintain the original properties.

The connecting part 222 is located at a root part of the blade body 221, and connected with the hub 21, the front edge 2211 and the rear edge 2212. In this embodiment, the connecting parts 222 are disposed on a suction surface 2214 and a pressure surface 2215 of the blade body 221 of each dynamic blade 22, respectively.

Please refer to FIGS. 1E-1F. FIG. 1E is a cross-sectional view of the impeller of FIG. 1C along the line A'-A. FIG. 1F is a cross-sectional view of the impeller of FIG. 1C along the line B-A. FIG. 1G is a cross-sectional view of the impeller of FIG. 1C along the line C-A. The curvature radius R of the connecting part 222 is gradually decreased along the direction from the front edge 2211 to the rear edge 2212. That is, as shown in FIG. 1C, the curvature radius R of the connecting part 222 is gradually decreased along the direction Y. In FIG. 1E, the connecting part 222 on the suction surface 2214 and the pressure surface 2215 of the blade body 221 has the curvature radius R1. In FIG. 1F, the connecting part 222 on the suction surface 2214 and the pressure surface 2215 of the blade body 221 has the curvature radius R2. In FIG. 1G, the connecting part 222 on the suction surface 2214 and the pressure surface 2215 of the blade body 221 has the curvature radius R3. It is found that R1>R2>R3.

Since the curvature radius R of the connecting part 222 is gradually decreased along the direction from the front edge 2211 to the rear edge 2212, the angle of the connecting part 222 corresponding to the curvature radius R of the connecting part 222 is gradually decreased along the direction from the front edge 2211 to the rear edge 2212. Under this circumstance, the structural strength of the dynamic blade 22 is enhanced, and the possibility of causing the vortex near the hub 21 will be reduced. Experiments showed that the conventional dynamic blade without the connecting part has a safety factor of 1.84 but the dynamic blade 22 of the present invention having the connecting part 222 with the varying curvature radius has a safety factor of 2.01. In other words, while the dynamic blade 22 is rotated at a high speed, the varying curvature radius of the connecting part 222 can enhance the structural strength of the dynamic blade 22.

Figure 3A:
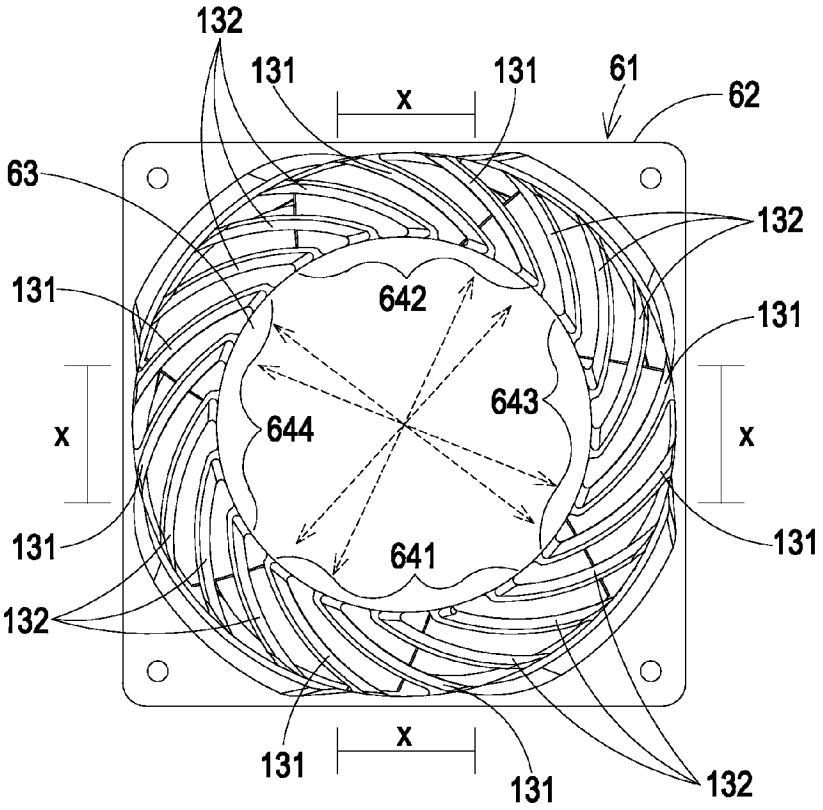
FIG. 3A is a front view of a fan according to a third embodiment of the present invention.
Figure 3B:
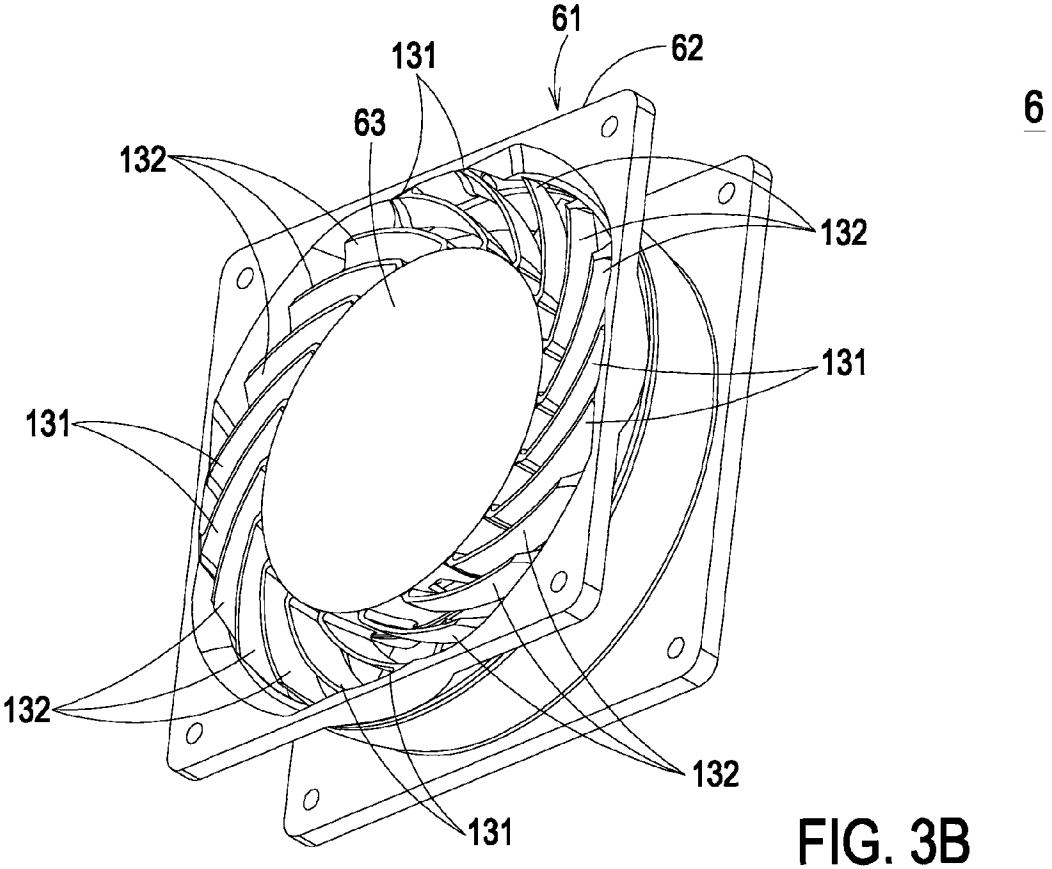
FIG. 3B is a perspective view of the fan shown in FIG. 3A.
Figure 3C:
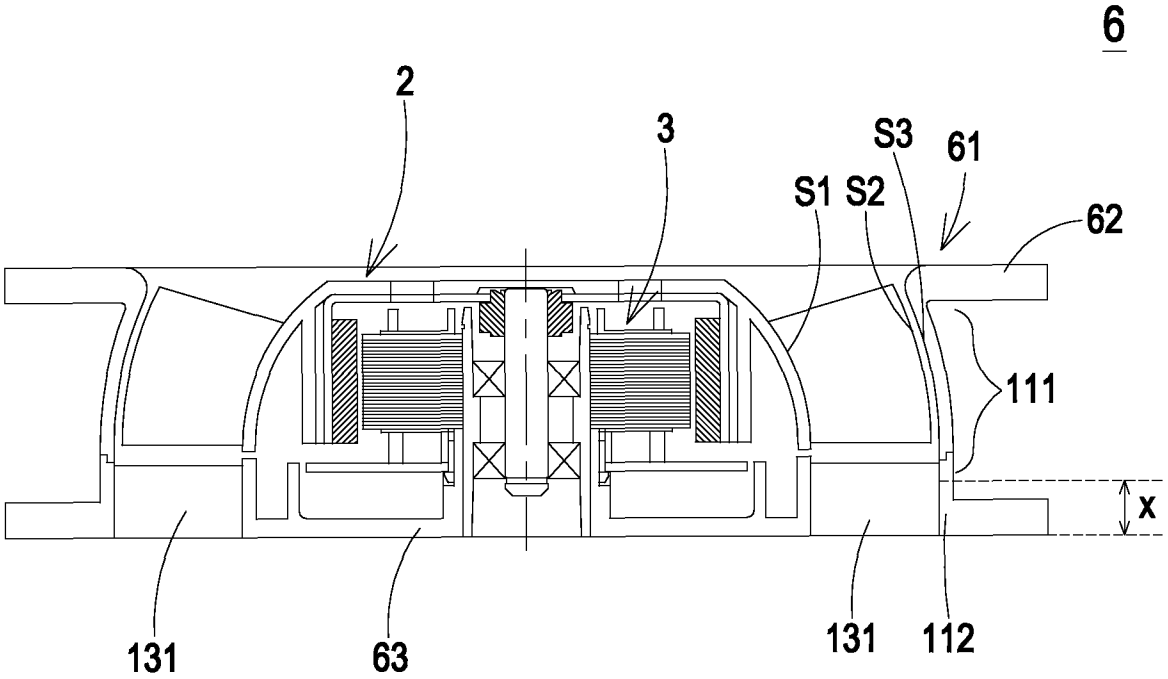
FIG. 3C is a cross-sectional view illustrating the fan shown in FIG. 3A.
Figure 3D:
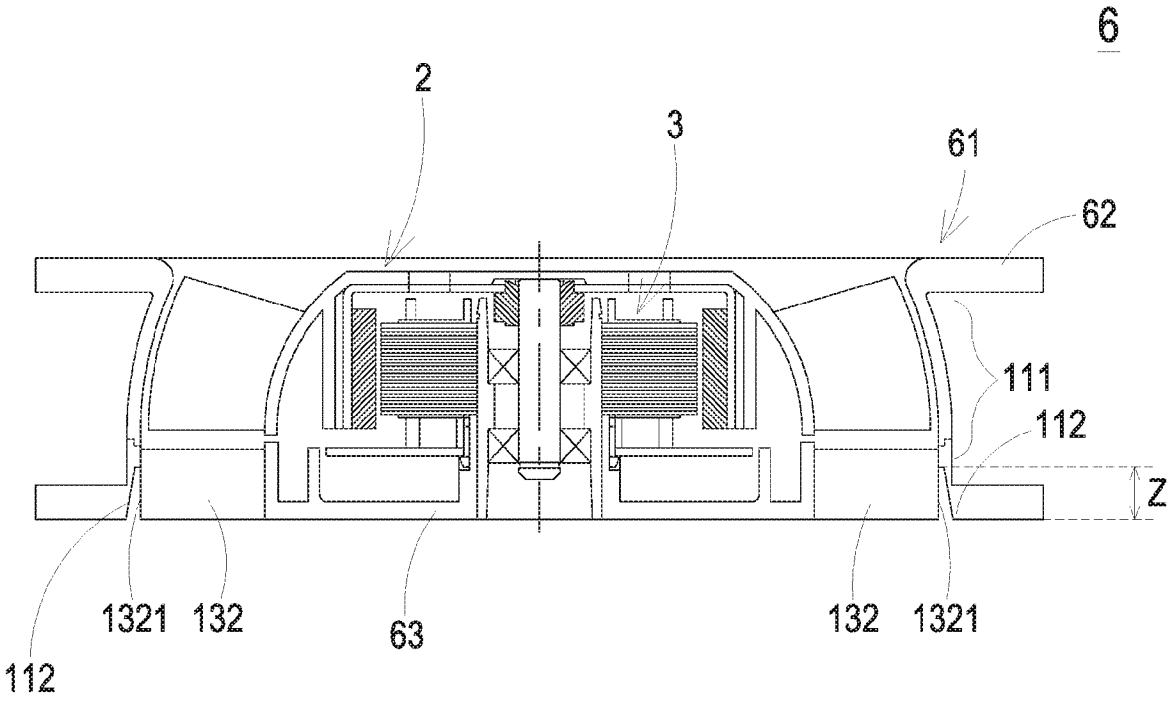
FIG. 3D is a cross-sectional view illustrating the fan shown in FIG. 3A along another viewpoint.

Hereinafter, a fan according to a third embodiment of the present invention will be illustrated with reference to FIGS. 3A-3D. FIG. 3A is a front view of a fan according to a third embodiment of the present invention. FIG. 3B is a perspective view of the fan shown in FIG. 3A. FIG. 3C is a cross-sectional view illustrating the fan shown in FIG. 3A. FIG. 3D is a cross-sectional view illustrating the fan shown in FIG. 3A along another viewpoint. In this embodiment, the fan 6 is a diagonal flow fan. The fan 6 comprises a frame 61, an impeller 2, and a motor 3. The impeller 2 and the motor 3 are accommodated within the frame 61. The motor 3 is used for driving rotation of the impeller 2.

In this embodiment, the hub of the impeller 2 has a curved outer surface S1, and the dynamic blade of the impeller 2 has a curved outer surface S2. Moreover, the frame body 62 has a curved inner surface S3, and the curved outer surface S2 and the curved inner surface S3 are in parallel with each other. The frame 61 of the fan 6 comprises a frame body 62, a base 63, and a plurality of static blade groups. The frame body 62 comprises a plurality of flat regions X. The flat regions X are located at corresponding lateral sides of the frame body 62.

In FIG. 3A, the frame 61 comprises four static blade groups 641, 642, 643 and 644. Each static blade group has the same number of static blades. Each flat region X of the frame body 62 is connected with two first static blades 131 of a corresponding static blade group. Moreover, each of the static blade groups 641, 642, 643 and 644 comprises five static blades, including two first static blades 131 and three second static blades 132. The two first static blades 131 are connected with a corresponding flat region X as shown in FIG. 3C. One end of the first static blade 131 is connected with the base 63. The other end of the first static blade 131 is partially connected with the axial part 111 and partially connected with the flat region X of the externally-expanded part 112. As shown in FIG. 3D, one end of the second static blade 132 is connected with the base 63 and the other end of the second static blade 132 is partially connected with the axial part 111. Preferably, the connection portion between the second end of the second static blade 132 and the axial part 111 is lower than one third of the height of the second static blade 132. Since the second end of the second static blade 132 is not connected with the externally-expanded part 112, the second static blade 132 has a suspension segment 1321 with respect to the externally-expanded part 112 as shown in FIG. 3D.

As known, since the static blade groups of the frame of the conventional fan are asymmetric, asymmetric flow fields are generated at the outlet of the fan. Under this circumstance, the conventional fan will result in serious vortex. In accordance with the present invention, the first static blades of two corresponding static blade groups are symmetric with respect to a central axis of the frame 61. In this embodiment, the static blades 131 of the two corresponding static blade groups 641 and 642 are symmetric with respect to the central axis of the frame 61, and the first static blades 131 of the two corresponding static blade groups 643 and 644 are symmetric (see the dotted lines as shown in FIG. 3A). Consequently, the outlet formed by the frame body 62 is divided into four identical flow fields, which are arranged around each other. Different flow fields will not be interfered with each other. Thus, the airflow at the outlet of the fan can be uniformly diffused and the possibility of causing vortex will be minimized. In other words, the heat of the electronic system can be uniformly dissipated away by the fan.

Figure 4:
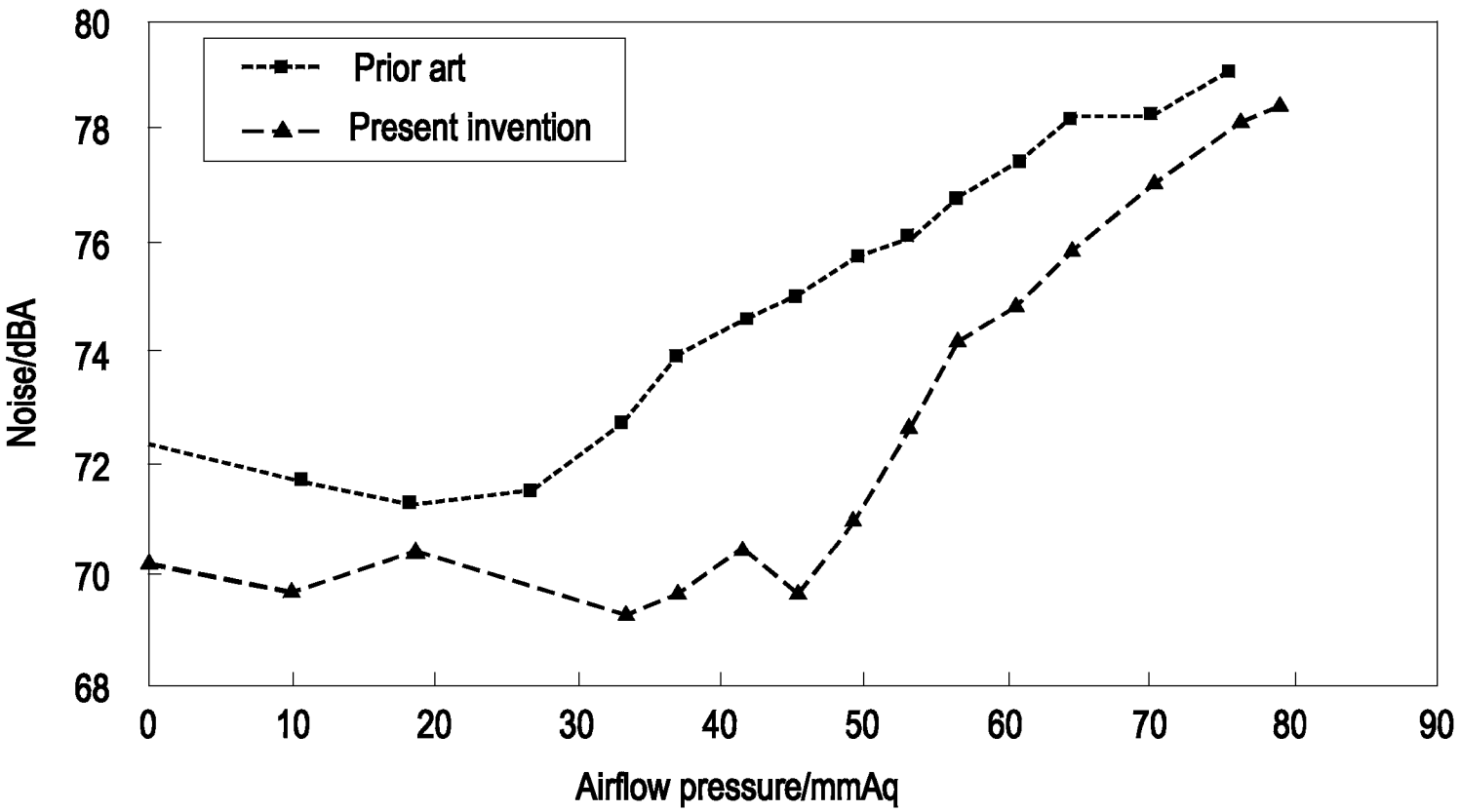
FIG. 4 is a plot illustrating the relationship between the airflow pressure and the noise (dB) of the fan of FIG. 1A in comparison with the conventional fan.

FIG. 4 is a plot illustrating the relationship between the airflow pressure and the noise (dB) of the fan of FIG. 1A in comparison with the conventional fan. In case that the fan of the present invention and the conventional fan produce the same airflow pressure (e.g. 46 mmAq), the noise resulted from the fan of the present invention is lower than the noise resulted from the conventional fan by up to 5 dBA. That is, the efficiency of reducing the noise by the fan of the present invention is superior to the conventional fan.

From the above descriptions, the present invention provides a fan. The fan comprises a frame. The frame comprises a plurality of static blade groups. Since at least one first static blade of a first static blade group and at least one first static blade of a second static blade group are symmetric with respect to a central axis of the frame, the outlet formed by the externally-expanded part of the frame is divided into a plurality of identical flow fields by the static blade groups. These flow fields are arranged around each other. Different flow fields will not be interfered with each other. Thus, the airflow at the outlet of the fan can be uniformly diffused and the possibility of causing vortex will be minimized. In other words, the heat of the electronic system can be uniformly dissipated away by the fan. As previously described, since the static blade groups of the frame of the conventional fan are asymmetric, asymmetric flow fields are generated at the outlet of the fan to result in serious vortex. In other words, the efficiency of reducing the noise by the fan of the present invention is superior to the conventional fan. Moreover, since each dynamic blade has a leading edge angle, the noise is effectively reduced, no obvious vortex is occurred in the flow field generated by the dynamic blade, and the fan can maintain the original properties. Moreover, since the curvature radius of the connecting part is gradually decreased along the direction from the front edge to the rear edge, the structural strength of the dynamic blade is enhanced and the possibility of causing the vortex near the hub is reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fan comprising:

an impeller; and a frame that houses the impeller, the frame comprising:

a frame body having an axial part and an externally-expanded part, an inner wall of the axial part and an inner wall of the externally-expanded part forming an airflow channel through the frame body, the externally-expanded part forming an outlet of the airflow channel, the inner wall of the externally-expanded part including a plurality of flat regions and an outwardly angled region positioned between each pair of adjacent flat regions;

a base that is positioned centrally within the frame body such that the airflow channel extends between the base and the frame body; and a static blade group, each static blade group including one or more first static blades and one or more second static blades;

wherein each first static blade extends between the base and the corresponding flat region, each first static blade having a first end that is connected to the base and a second end that is connected to the frame body such that a first portion of the second end is connected to the inner wall of the axial part and a second portion of the second end is connected to the corresponding flat region, so that the second end of each first static blade is completely connected with and not spaced from the frame body; and wherein each second static blade extends between the base and the outwardly angled region that is adjacent to the corresponding flat region, each second static blade having a first end that is connected to the base and a second end that is connected to the frame body such that a first portion of the second end is connected to the inner wall of the axial part and a second portion of the second end forms a suspension segment that is spaced from the outwardly angled region.

2. The fan of claim 1, wherein the plurality of flat regions are located at lateral sides of the frame body.

3. The fan of claim 1, wherein the plurality of flat regions comprise four flat regions such that there are also four outwardly angled regions.

4. The fan of claim 1, wherein at least one of the static blade groups includes one or more second static blades on each side of the one or more first static blades.

5. The fan of claim 1, wherein a height of the first portion of the second end of the second static blade is less than one third of a height of the second portion of the second end of the second static blade.

6. The fan of claim 1, wherein the static blade groups are arranged symmetrically around a central axis of the frame.

7. The fan of claim 1, wherein the impeller comprises:

a hub; and a plurality of dynamic blades connected with the hub, wherein each of the dynamic blades comprises a blade body, the blade body comprising a front edge and a rear edge, wherein an extending direction of the front edge and the rear edge is the same as a rotating direction of the impeller.

8. The fan of claim 7, wherein each dynamic blade further comprises a connecting part that is located at a root part of the blade body, the connecting part being connected with the hub, the front edge and the rear edge.

9. The fan of claim 8, wherein a curvature radius of the connecting part is gradually decreased along a direction from the front edge to the rear edge.

10. The fan of claim 8, wherein the blade body further comprises a wing tip opposed to the connecting part and connected with the front edge and the rear edge, wherein the wing tip is twisted and extended along a rotating direction of the dynamic blade so that each dynamic blade has a leading edge angle.

11. The fan of claim 10, wherein the leading edge angle is defined between a first line passing through a center of the hub and a farthest end point of the front edge and a second line passing through the center of the hub and an end point at a junction between a root part of the front edge and the hub.

12. The fan of claim 11, wherein the leading edge angle is in a range between 15 degrees and 50 degrees.

13. The fan of claim 7, wherein the hub has a curved outer surface and the dynamic blade has a curved outer surface.

14. The fan of claim 1, wherein the fan is an axial-flow fan or a diagonal flow fan.

15. The fan of claim 1, wherein at least one of the static blade groups has a different number of static blades than at least one other static blade group.

16. The fan of claim 1, wherein the frame body is square or circular.

17. The fan of claim 1, wherein the inner wall of the axial part is curved inwardly and parallel with a curved outer surface of blades of the impeller.

18. The fan of claim 1, wherein a hub of the impeller has a curved outer surface.

19. The fan of claim 1, wherein at least one of the static blade groups includes one or more second static blades on one side of the one or more first static blades and no second static blades on the opposite side of the one or more first static blades.

20. The fan of claim 1, wherein the static blade groups are arranged to divide the outlet of the airflow channel into a plurality of identical flow fields.

* * * * *